United States Patent [19]

Goldfarb et al.

[11] 3,995,392

[45] Dec. 7, 1976

[54] TOY FLYING VEHICLE SET

[75] Inventors: Adolph E. Goldfarb, Tarzana; Erwin Benkoe, Encino; Delmar K. Everitt, Woodland Hills; Ronald F. Chesley, La Crescenta; Richard D. Frierdich, Canoga Park, all of Calif.

[73] Assignees: Adolph E. Goldfarb; Erwin Benkoe

[22] Filed: Jan. 21, 1975

[21] Appl. No.: 542,726

[52] U.S. Cl. ..... 46/78; 46/83

[51] Int. Cl.[2] ..... A63H 27/00

[58] Field of Search ..... 46/76 R, 82, 83, 84, 46/85, 78

[56] References Cited

UNITED STATES PATENTS

| | | | |
|---|---|---|---|
| 2,802,299 | 8/1957 | Lohr | 46/83 |
| 3,704,540 | 12/1972 | Montagu | 46/83 |

FOREIGN PATENTS OR APPLICATIONS

| | | | |
|---|---|---|---|
| 1,185,522 | 1/1965 | Germany | 46/84 |

*Primary Examiner*—Louis G. Mancene
*Assistant Examiner*—Jack Q. Lever
*Attorney, Agent, or Firm*—Robert M. Ashen; Robert J. Schaap

[57] ABSTRACT

A propeller-driven toy flying vehicle set which includes a hand-held launcher and a propeller-driven toy flying vehicle detachably mounted on the handle. The toy flying vehicle, which may be in the form of an airplane, has a body with wings and a propeller which is substantially oversized with respect to the body and wings of a conventional propeller-driven airplane. A gear-driven mechanism is included within the hand-held launcher which is actuated by pulling a member, such as a string, to impart rotation to the vehicle propeller while the toy vehicle is retentively held on the hand-held launcher. The gear train includes multiplier means, in the form of step-up gears, to increase the speed of rotation imparted to the propeller through the pulling of the string. After the string has been pulled sufficiently at least such that the speed of rotation of a drive shaft in the mechanism is less than the speed of rotation to the propeller, a coupling means detaches the toy vehicle from the launcher permitting the toy flying vehicle to "take-off" into flight.

28 Claims, 9 Drawing Figures

A
10
11
12
14
16
17
18
20
36
38
40
42
50
52
62
64
72
74
76
78
80
82
84
86
88
92
94
96
98
108
110
7
9

TOY FLYING VEHICLE SET

BACKGROUND OF THE INVENTION

This invention relates in general to certain new and useful improvements in toy flying vehicle sets and, more particularly, to propeller-driven toy flying vehicle sets in which a toy flying vehicle is detachably mounted on a hand-held launcher.

There are a number of commercially available toys in which rotation is imparted to one or more rotating members of the toys by pulling out a pull-string against the pressure of a rubber band or spring in order to actuate or "load" the rubber band or the rotating member. Other forms of toys also include a pull-string, which is pulled out against the pressure of a rubber band or spring, and which return the pull-string to its original position at the end of the pulling stroke.

However, toy flying vehicles of the type heretofore produced, particularly of the propeller-driven type, were not capable of being launched from a hand-held launcher. Generally, if such toys were launched from a launcher, the launched portion comprised only a helicopter operable through a helicopter rotor blade. One such toy representative of the prior art is more fully illustrated and described in British Patent No. 743,102, dated Jan. 11, 1956. It was generally found that a propeller-driven airplane was ineffective in hand operated launching for flight in any horizontal trajectory due to the fact that the propeller was not able to provide the necessary pulling force to hold the airplane in flight. It was found that the propeller would cause rotation of the body. Stabilizing of the vehicle usually resulted in low-speed flying capabilities with the duration of the flight being relatively short.

The present invention overcomes these and other problems in the provision of a toy flying vehicle set including a hand-held launcher and a propeller-driven toy flying vehicle which is detachably mounted on the hand-held launcher through an interlock mechanism. When a pull-string is drawn from the launcher, rotation is imparted to a gear train which, in turn, rotates the propeller shaft on the propeller-driven vehicle, such as a toy airplane. Furthermore, the various gears are properly sized so as to produce an accelerator effect, thereby substantially increasing the speed of rotation of the propeller permitting high-speed flying of the toy vehicle has a relatively long duration.

It is therefore the primary object of the present invention to provide a toy flying vehicle set which is capable of being actuated by a pull-string to impart rotation to a propeller on the toy flying vehicle and which permits launching of the toy flying vehicle from a hand-held launcher.

It is another object of the present invention to provide a toy flying vehicle set of the type stated which is constructed of a minimum number of pieces and is relatively durable in its construction.

It is a further object of the present invention to provide a toy flying vehicle set of the type stated which requires a relatively small amount of manual labor for construction thereof and which can therefore be manufactured at relatively low unit costs.

It is another salient object of the present invention to provide a toy flying vehicle set of the type stated which includes a unique interlock which detachably couples a drive shaft in the launcher to a propeller shaft on the flying vehicle.

With the above and other objects in view, our invention resides in the novel features of form, construction, arrangement and combination of parts presently described and pointed out in the claims.

SUMMARY OF THE DISCLOSURE

A toy flying vehicle set which includes a launcher, preferably a hand-held launcher, and a toy flying vehicle, preferably a propeller-driven toy airplane. The launcher and the airplane are preferably formed of plastic materials with a minimum number of parts and which can be assembled with ease to produce a toy set of relatively low costs.

The launcher comprises an outer housing which includes a gear-containing drive mechanism retained within the housing. A drive shaft means is operatively connected to the gear-containing drive mechanism and is rotated thereby. An actuating means actuates this drive mechanism to impart rotation to the drive shaft means upon manual actuation of an actuating means. In this case, the actuating means preferably adopts the form of a pull-string. Finally, an interlock means is operatively associated with one end of the drive shaft.

The toy airplane also includes a vehicle body and a rotating member which includes a rotatable shaft for driving the vehicle body when rotation is imparted to the rotating shaft means. Again, the rotating shaft means preferably adopts the form of a propeller shaft which has a propeller secured to the propeller shaft at the forward end of the airplane body. In addition, a cooperating means is located on the rearward end of the propeller shaft and is engageable in detachably interlocking relationship with the interlock means, and is detachable therefrom when a rotation velocity differential results between the propeller shaft and the drive shaft.

In a preferred aspect of the present invention, the propeller is an energy storing propeller and includes means to store the rotary energy which is imparted thereto by means of the drive shaft. Also in a preferred embodiment of the present invention, a rewind means is included within the launcher to return the pull-string to its original position after a pull stroke. This rewind means may adopt the form of a resilient and elastic energy storing member which is capable of rotating a drum forming part of the drive mechanism in order to pull the string to its initial position after the pull stroke.

The gear containing drive mechanism also includes an accelerator means to substantially increase the speed of rotation imparted to the propeller shaft. This accelerator means may adopt the form of a substantially large drive gear in the form of a spur gear which is disposed in meshing engagement with a relatively small pinion gear mounted on the drive shaft.

The interlock means referred to above comprises a member having a somewhat spiral slot located at the forward end of the drive shaft. The cooperating means forms part of this interlock means and includes a flange which is extendable into the slot and is removable therefrom upon rotation of the propeller shaft. Generally, the flange will be removable from this slot when the speed of rotation of the drive shaft is decreased with respect to the speed of rotation of the propeller shaft, which in effect causes the flange to unwind from the slot.

BRIEF DESCRIPTION OF THE DRAWINGS

Figures 1, 7, 8, 9:
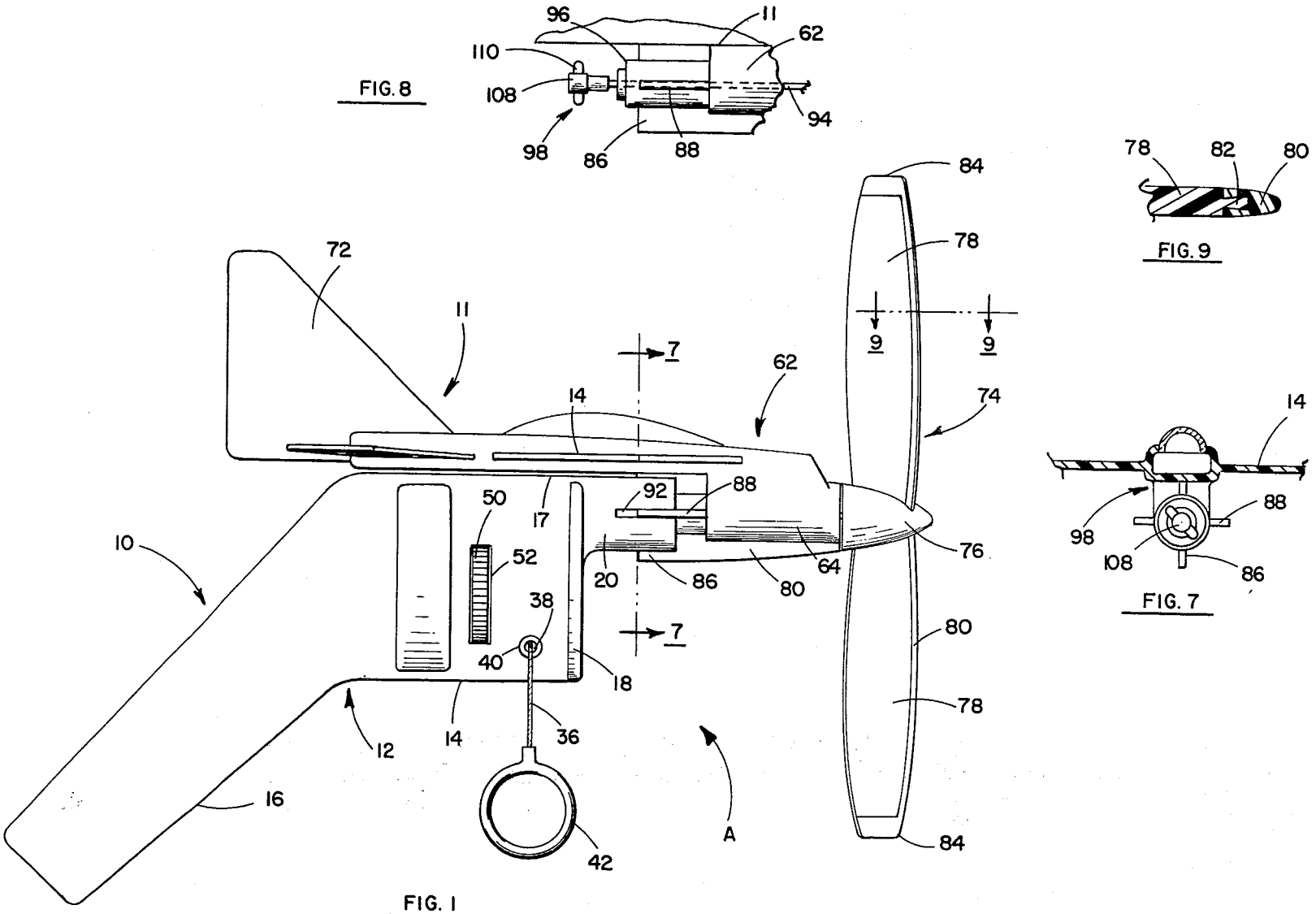
Figure 2:
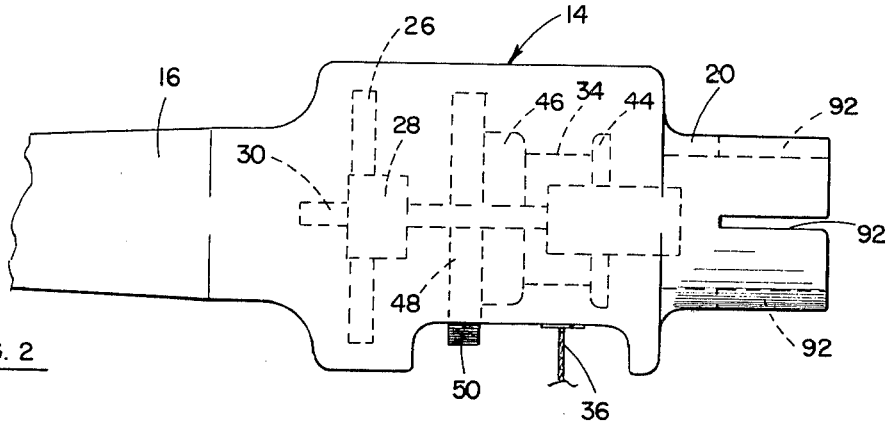
Figure 3:
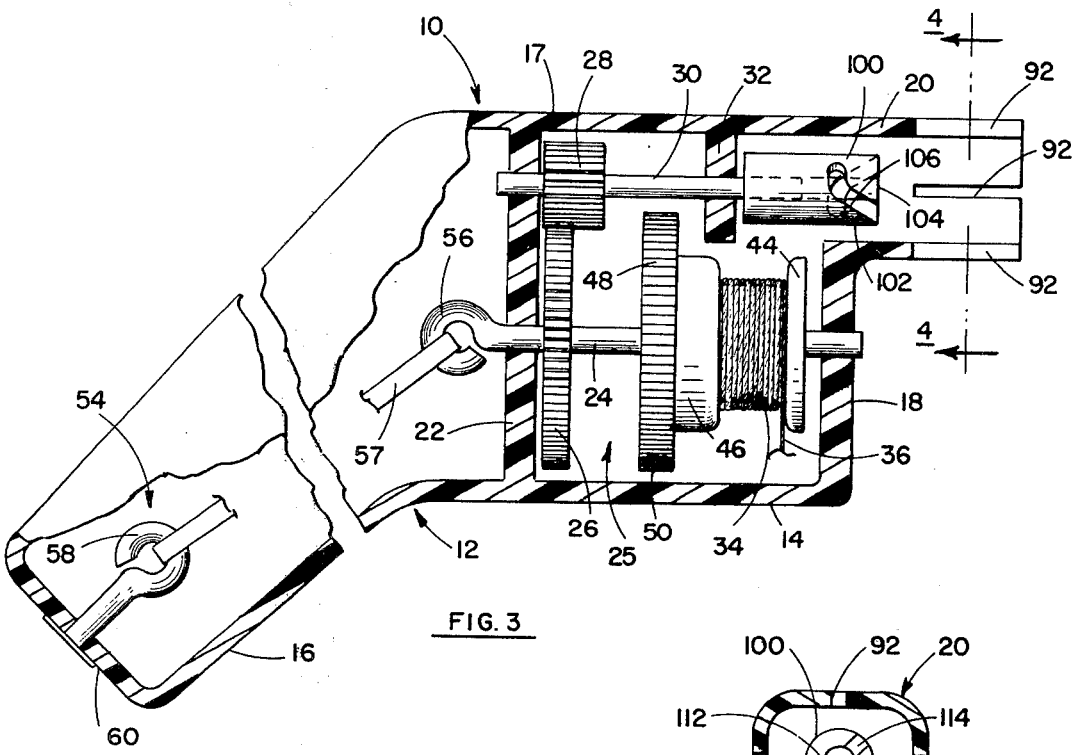
Figure 4:
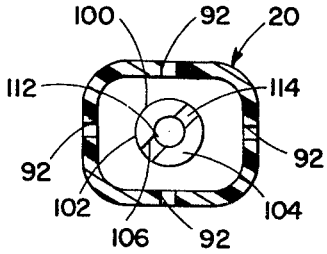
Figure 5:
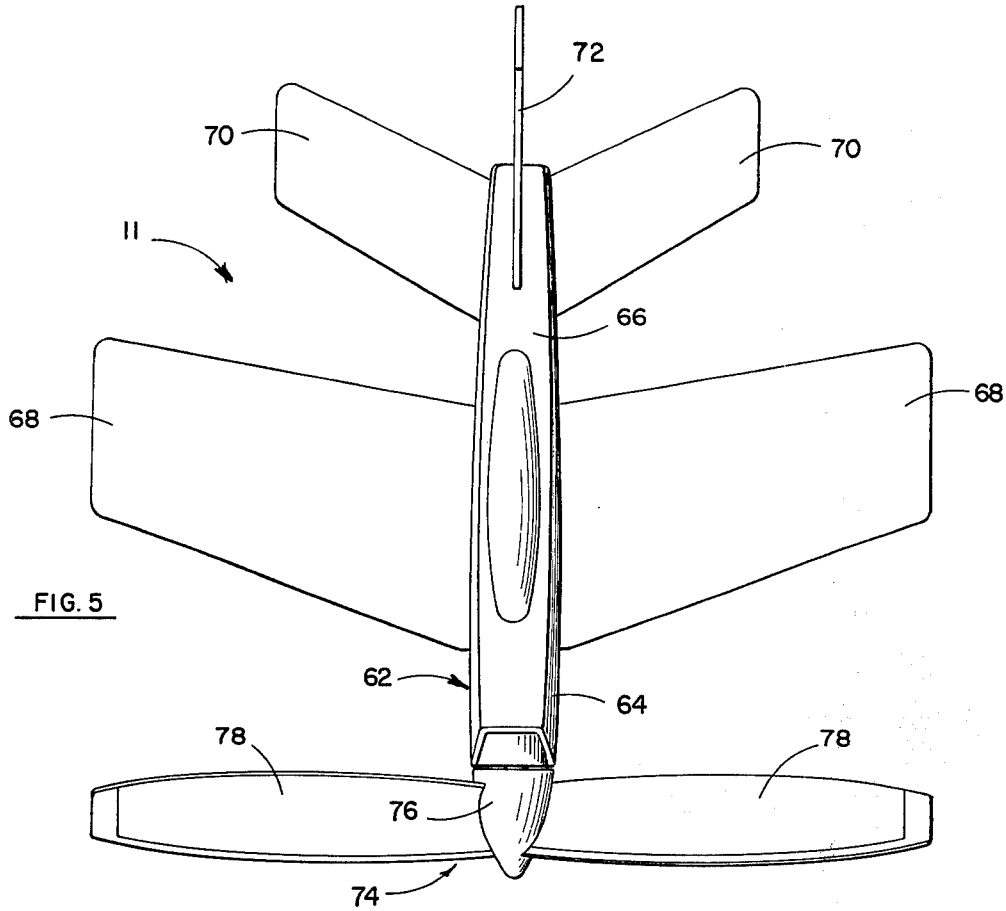
Figure 6:
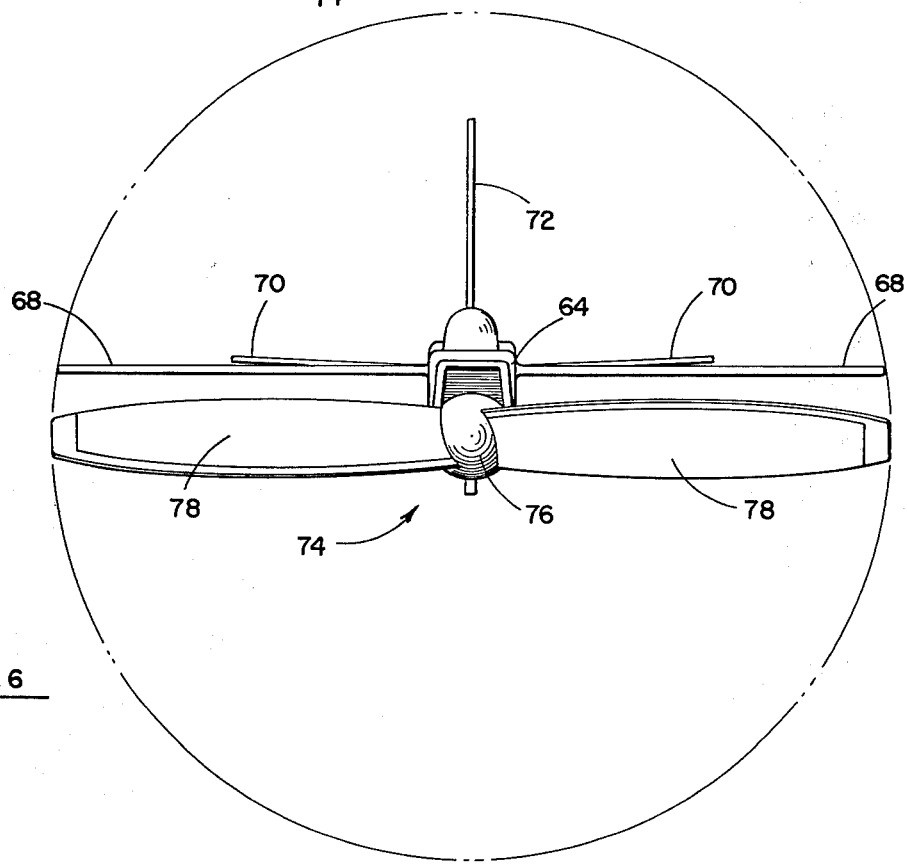

Having thus described the invention in general terms, reference will now be made to the accompanying drawings in which:

FIG. 1 is a side elevational view of a toy flying vehicle set constructed in accordance with and embodying the present invention and including a hand-held launcher and a detachably mounted flying vehicle;

FIG. 2 is a top plane view of a portion of the hand-held launcher, with a portion of the drive mechanism includes therein being illustrated in dotted lines;

FIG. 3 is a vertical sectional view, partially broken away, and showing the interior portion, including the drive mechanism of the hand-held launcher;

FIG. 4 is a vertical sectional view taken along line 4—4 of FIG. 3;

FIG. 5 is a top plan view of the toy flying vehicle forming part of the set of the present invention;

FIG. 6 is a front elevational view of the toy flying vehicle of the present invention;

FIG. 7 is a vertical sectional view taken along line 7—7 of FIG. 1;

FIG. 8 is a side elevational view of a portion of the interlock mechanism which connects the drive shaft of the drive mechanism to the propeller shaft of the flying vehicle; and FIG. 9 is a fragmentary sectional view taken along line 9—9 of FIG. 1.

DETAILED DESCRIPTION

Referring now in more detail and by reference characters to the drawings, FIG. 1 illustrates a hand-held toy flying vehicle set comprising a hand-held launcher 10, often referred to as a "launching handle", and a propeller-driven vehicle 11 which may adopt the form of a propeller-driven airplane.

The launcher 10 includes an outer housing 12, having a somewhat cylindrically shaped drive housing section 14 and an integrally formed, elongated, downwardly projecting handle section 16, in the manner as illustrated in FIG. 1 of the drawings. The upper exteriorly presented wall of the drive housing section is relatively flat to provide a launching surface 17. The drive housing section 14 is also partially closed at its forward end, reference being made to FIGS. 1 and 3, by means of an integrally formed, vertically struck forward end wall 18. At its forward end, the housing is integrally provided with a forwardly projecting, somewhat rectangularly shaped hub 20, for reasons which will presently more fully appear.

The housing 12 is preferably formed of a suitable plastic material, such as polyethylene, polystyrene, polybutadiene or any of a number of known other plastic materials. In addition, the housing 12 is uniquely shaped so that it may be injection molded, thermoformed or otherwise formed in any of a number of known plastic forming operations. However, it should be understood that the housing 12 could be formed of any of a number of other lightweight materials, such as lightweight metals, fiber reinforced plastics, or the like.

Located within the housing 12 is an intermediate, vertically disposed support wall 22 which is preferably integral with the housing 12 and separates the drive housing section 14 from the handle section 16, in the manner as illustrated in FIG. 3 of the drawings. An axially extending stub shaft 24 forming part of a drive mechanism 25 is located within the drive housing section 14 and is journalled in the vertically disposed forward end wall 18 and the intermediate support wall 22. In this respect, suitable bearings, sleeves, or the like, may be located within the respective vertically disposed walls 18 and 22 for journalling the stub shaft 24. Fixedly mounted on the stub shaft 24 and being rotatable therewith in proximate relation to the intermediate support wall 22 is a relatively large diameter spur gear 26. This spur gear 26 is disposed in meshing engagement with a relatively small diameter pinion gear 28, the latter being mounted on a drive shaft 30.

By further reference to FIGS. 2 and 3 of the drawings, it can be observed that one end of the drive shaft 30 is journalled in the intermediate vertically disposed wall 22 and another portion of the drive shaft 30 is journalled in a depending flange 32 which projects inwardly from the upper portion of the cylindrically shaped drive housing section 14. Again, it should be observed that the drive shaft 30 could also be journalled in the flange 32 and the intermediate support wall 22 with suitable bearings, or the like. It should also be observed that the drive shaft 30 is preferably located in parallel relationship to the stub shaft 24 and, furthermore, is in vertically disposed alignment with the stub shaft 24.

Also fixedly mounted on the stub shaft 24 for rotation therewith is a drum 34 upon which is wound a pull-string 36, which may be formed of any flexible cord-type material. By reference to FIG. 1, it can be observed that the pull-string 36 projects through an aperture 38 formed in the drive housing section 14 and which may be suitably provided with a grommet 40. The outer end of the pull-string 36 is provided with an enlarged ring 42 which is sized to be engaged by a finger of the user of the toy A. The drum 34 is provided with a diametrally enlarged flange head 44 and 46 which prevents the string from being unauthorizedly removed from the drum 34.

Secured to the rearward end of the flange head 46 and being rotatable with the stub shaft 24 is a manually operable wind-up wheel 48 which is provided with an outer knurled annular surface 50, and which projects through a slot 52 formed within the side wall of the drive housing section 14. In this case, the manually operable wind-up wheel 48 may be used for manually winding up the pull-string 36 on the drum 34 in the event that an automatic wind-up mechanism (hereinafter described) does not effectively operate.

An automatic wind-up mechanism 54 is located in the handle portion 16 of the housing 12. The wind-up mechanism 54 comprises a hook 56 which is located at, and preferably is integrally formed on, the rearward end of the stub shaft 24. A rubber band or similar resilient and elastic member 57 extends between the hook 56 and a similar hook 58 mounted on the lower end wall 60 of the handle 16. In this way, it can be observed that as the pull-string 34 is manually engaged at the ring 42 and unwound from the drum 34, the rubber band 56 or similar elastic member will wind-up. After the pull-string has been pulled outwardly from the housing 12 in a complete pull stroke, the elastic energy which has been introduced into the rubber band 57 will cause the stub shaft 24 to rotate in the opposite direction, and, hence, rewind the pull-string 36 on the drum 34. It should be understood in this respect, that a spring or similar energy storing member may be used in place of the rubber band 57.

Again, it should be recognized that the various components forming part of the drive mechanism within the drive housing portion 14 could also be suitably formed of any of the above-mentioned plastic materials or other plastics known in the art. Again, and in like manner, these components could also be formed of other materials, typically lightweight metals, although plastics are preferred due to the ease of manufacture, reliable tolerances and low-cost factors involved.

The toy flying vehicle 11 preferably adopts the form of a toy airplane 11 having a longitudinally extending body or so-called "fuselage" 62, and includes a cylindrically shaped pod or engine nacelle 64 forming part of the fuselage 62. Secured to, or otherwise integrally formed with, the fuselage 62 are a pair of opposed, laterally outwardly extending wings 68. Also extending laterally outwardly from the fuselage 62 are a pair of opposed tail fins 70 often referred to as "stabilizers". In addition, an upstanding tail 72 or so-called "vertical stabilizer" extends upwardly from the fuselage 62.

Suitably mounted at the forward end of the engine pod 64, in a manner to be hereinafter described, is a propeller 74 comprised of a propeller nose or hub 76 having a pair of outwardly extending propeller blades 78. The propeller blades 78 are preferably formed of a plastic material and may optionally include along the leading edges or so-called "pitch edges" of the blades 78 (that is, the forwardly projected portion of the blades) relatively soft propeller edges 80, in the manner as illustrated in FIGS. 1 and 9 of the drawings, in order to provide a safety feature. The edges 80 may be secured to the blades 78 by means of a tongue and groove construction, as illustrated at 82 in FIG. 9 of the drawings. Finally, the propeller blades 78 are provided with relatively soft safety propeller tips 84 at their outer ends. These tips 84 in a preferred embodiment could also be weighted in order to increase the rotary inertial force imposed on the propeller 74. One of the unique aspects of the present invention is that the tips 84 may be actually molded with the blades 78.

By further reference to FIGS. 1, 5 and 6, it can be observed that the propeller 74 is preferably quite larger with respect to the wings 68 and tail 78 as well as the fuselage 62 generally of the airplane 11 than the normal proportional sizes existing between a propeller and a conventional aircraft. These proportional sizes are provided in order to maintain a greater and longer flight duration with significantly increased speed.

In this particular case and by reference to FIGS. 5 and 6 of the drawings, it can be observed that the propeller 64 has an overall length approximately equal to the overall dimension of the wings 68 as measured laterally from tip to tip. The exact size of the wings will vary depending on the weight of the flying vehicle 11 which in turn depends on the particular design thereof. Moreover, in cases where the flying vehicle 11 is constructed in the form of a biplane, that is a plane with vertically spaced pairs of wings, the propeller may be somewhat shorter. Nevertheless, in each case, the propeller 74 will always be significantly larger than that employed in conventional propeller-driven aircraft.

It should also be observed that the propeller 74 is also significantly increased in overall size with respect to the overall length of the fuselage 62. Thus, the propeller 74 may have a length which is about the same length as measured in the longitudinal dimension, of the fuselage 62. Even moreso, the tail 78 has an overall height, with respect to the length of the fuselage 62, which is substantially greater than the height of a conventional tail to the fuselage of a conventional propeller-driven aircraft.

In the preferred aspect of the present invention, the propeller 74 has an overall length at least greater than one half the overall dimension of the wings 68 as measured from tip to tip (hereinafter referred to as "wing dimension") and is preferably at least two-thirds of the wing dimension. In the most preferred embodiment of the invention, the propeller 74 has an overall length which is approximately equal to the wing length. Moreover, the tail 72 has a height which is equal to at least one-fourth of and preferably one-third of the overall length of the fuselage 62.

By maintaining the size relationships specified above, it has been found that the propeller can be wound to sufficient speed to carry the vehicle 11 in a relatively long flight path at high speeds. Moreover, the overall length of the propeller 74 serves to effectively "store" rotational energy, as aided by the weighted sections 84, in the form of rotational inertia.

The engine pod 64 is integrally provided with a vertical pod flange 86 and a pair of laterally struck horizontal pod flanges 88 to provide four quadrilaterally arranged rearwardly struck retaining flanges 90, which are designed to retentively, but nevertheless slidably, fit within four quadrilaterally located slots 92 formed within the hub 20 and which slots 92 are sized and shaped to removably accommodate the retaining flanges 90. In this way, the top airplane 11 can be retained on the launcher 10 until such time as it is to be launched in a manner to be hereinafter described in more detail.

In this respect, it can be observed by further reference to FIG. 1 that the engine pod 64 and hence the flanges 90 extend downwardly from the fuselage 62 so that the lower surface of the fuselage 62 can be disposed on the launching surface 77. Consequently, the toy flying vehicle 11 can be held in a relatively horizontal position on the launcher 10, when the launcher 10 is held in a horizontal position. In essence, the initial flight trajectory of the vehicle 11 will be substantially parallel to the launching surface 17 by means of this construction.

The nose 76 of the propeller 74 is mounted on a propeller shaft 94 which extends through the fuselage and is journalled near its rearward end in a bearing 96 which is located and mounted to the four retaining flanges 90 at their point of intersection. The forward end of the engine pod 64 is also provided with a bearing 97 (illustrated in dotted lines in FIG. 1), similar to the bearing 96 in order to journal the forward end of the propeller shaft 94. Due to the fact that the pod 64 is of relatively short dimension, the bearings 96 and 97 can be spaced fairly closely together to reduce frictional drag on the shaft 94.

The rearward end of the propeller shaft 94 is provided with a coupling mechanism 98 which cooperates with a coupling mechanism 100 located on the forward end of the drive shaft 30 and which coupling mechanisms 98 and 100 cooperate to form an interlock. In this respect, it can be observed that the hub 20 is adapted to receive the coupling mechanism 98 on the rearward end of the propeller shaft 94.

The coupling mechanism 100 comprises a cylindrically shaped relatively solid collar 102 having a relatively flat forwardly presented wall or so-called "front wall" 104. A somewhat spirally shaped slot 106 is formed into the front wall 104 and projects into the sleeve 102, in the manner as illustrated in FIG. 3 of the drawings.

The coupling mechanism 98 includes a diametrally enlarged collar 108 mounted on the rearward end of the propeller shaft 94 and is provided with a pair of diametrally opposed outwardly extending engaging flanges 110. In this respect, it can be observed that the slot 106 is formed with a cylindrically enlarged section 112 and a pair of diametrally opposed, radially extending slot-forming recesses 114 in order to accommodate the size and the shape of the coupling mechanism 98.

In this way, it can be observed that when the toy plane 11 is retained on the launcher 10, the collar 108 and the flanges 110 will extend into the slot 104 of the coupling mechanism 100. When rotation is imparted to the main drive shaft 30, and hence the collar 108, the propeller shaft 94 will also rotate and, in this case, the main drive shaft 30 and the propeller shaft 94 will have common rotational velocities. When no further rotational force is imparted to the drive shaft 30, the speed of rotation of the drive shaft 30 will decrease relative to the speed of rotation of the propeller shaft 94. At this point, the coupling mechanism 98 will automatically remove itself and work itself out of the slot 106 and thereby disengage the interlock created therebetween.

In use, the pull-string 36 is normally fully wound upon the drum 34. The user of the toy would merely couple the airplane 11 to the launcher 10 by inserting the flanges 90 into the elongated slots 92. As this occurs, the coupling mechanism 98 will extend into the slot 106 of the coupling mechanism 100. When the user of the toy wishes to propel the airplane, he merely grasps the ring 42 and pulls the same outwardly of the housing 12 so that rotation is imparted to the stub shaft 24 and the spur gear 26 will rotate the pinion gear 28 and the drive shaft 30. As this occurs, the coupling mechanism 98 will break the interlock with respect to the coupling mechanism 100 after a speed of rotation differential exists between the shafts 30 and 94. The propeller 74, which now has a sufficient speed of rotation imparted thereto, will pull the toy plane 11 off of the launcher 10. When the user of the ring of the toy A releases the pull-string 36, the rewind mechanism 54 will thereupon fully wind the pull-string 36 on the drum 34.

Thus, there has been illustrated and described a novel toy flying vehicle set which can be made at a relatively low cost and in a durable construction and which can be used in a wide variety of applications. Consequently, this toy set fulfills all of the objects and advantages sought therefor. Many changes, modifications, variations and other uses and applications of the toy set will become apparent to those skilled in the art after considering this specification and the accompanying drawings. All such changes, modifications, variations and other uses and applications which do not depart from the spirit and scope of the invention are deemed to be covered by the invention which is limited only by the following claims.

Having thus described our invention, what we desire to claim and secure by letters patent is:

1. A toy set comprised of:

a. a launcher comprising:

1. a housing,
2. a gear containing drive mechanism retained by said housing,
3. drive shaft means operatively connected to said gear containing drive mechanism,
4. actuating means for actuating said drive mechanism and thereby imparting rotation to said drive shaft means upon manual actuation of said actuating means,
5. interlock means including a coupling mechanism operatively associated with one end of said drive shaft means, a collar forming part of said coupling member and having an arcuately shaped flange receiving slot, b. a flying vehicle comprising:

1. a vehicle body,
2. a pair of wings extending from said vehicle body,
3. a rotary member including rotary shaft means associated with said body for driving said body when rotation is imparted to said rotary shaft means,
4. a propeller driven by said rotary shaft means in a plane substantially perpendicular to the plane of extension of said wings,
5. and cooperating means including a flange extending radially outwardly with respect to said rotary shaft means on one end of said rotary shaft means engageable in detachably interlocking relationship with said flange receiving slot in said interlock means by extending into said slot and being locked therein when said rotary shaft means is not rotating, said flange being detachable from said slot upon rotation of said rotary shaft means when the speed of rotation of said drive shaft means decreases relative to the speed of rotation of said rotary shaft means so that said flying vehicle is capable of being propelled into flight with an initial horizontal trajectory.

2. The toy set of claim 1 further characterized in that the rotary member of said toy vehicle comprises a propeller located on said body for driving said body when rotation is imparted thereto, and said rotary shaft means is a propeller shaft connected to said propeller.

3. The toy set of claim 2 further characterized in that said propeller is an energy storing propeller and comprises means to store rotary energy.

4. The toy set of claim 1 further characterized in that said actuating means comprises a pull-string to impart rotation to at least one gear in said gear containing drive mechanism upon pulling of said string.

5. The toy set of claim 4 further characterized in that rewind means is operatively associated with said housing to return the pull-string to its original position after a pull stroke.

6. The toy set of claim 4 further characterized in that said gear containing drive mechanism comprises accelerator means to substantially increase the speed of rotation imparted to said rotary shaft means.

7. The toy set of claim 1 further characterized in that said interlock means comprises a member having a somewhat circularly shaped slot, and said cooperating means form part of said interlock means and comprises a flange extendible into said slot and being removable therefrom upon rotation of said rotary shaft means relative to rotation of said drive shaft means.

8. The toy set of claim 1 further characterized in that said flange is removable from said slot only when the speed of rotation of said rotary shaft means exceeds the speed of rotation of said drive shaft means.

9. The toy set of claim 1 further characterized in that said gear containing drive means includes a member projecting through said housing for manual actuation to return the pull string to its original position.

10. The toy set of claim 1 further characterized in that said launcher is a hand-held launcher and includes a handle portion on said housing, and said flying vehicle is a toy propeller-drive airplane.

11. A method of launching a propeller-driven toy vehicle having a fuselage and a vertically disposed propeller from a hand-held launcher in an initial trajectory in a substantially horizontal plane, said method comprising:

a. providing a propeller shaft on one end of a horizontally extending fuselage of said vehicle and a drive shaft in said launcher,
b. connecting one end of the propeller shaft to approximately located end of the drive shaft through an interlock,
c. providing a drive mechanism in said launcher to rotate said drive shaft,
d. pulling an actuating cord connected to said drive mechanism to enable rotary motion to be produced,
e. accelerating the rotary motion thus produced in said drive mechanism,
f. and decoupling the interlock only when the speed of rotation of said propeller shaft exceeds the speed of rotation of said drive shaft to permit the vehicle to leave the launcher in an initial horizontal plane and become airborne.

12. The method of claim 11 further characterized in that the method comprises returning the actuating cord to its original position after the pulling stroke.

13. The method of claim 11 further characterized in that said method comprises storing rotary energy in the propeller.

14. A toy vehicle set for propelling a propeller driven toy aircraft from a hand-held launcher, said toy vehicle set comprising:

a. a hand-held launcher comprised of
1. a frame means,
2. a launching means on said frame means to retain and enable launching of said aircraft and having a launching surface capable of being disposed in a relatively horizontal plane,
3. motive means retained by said frame means to generate rotary motion,
b. a propeller driven toy aircraft comprised of
1. a body having a lower surface supported by said launching surface,
2. a rotatable propeller associated with said body and being disposed in a substantially vertical plane for rotation in a substantially vertical plane perpendicular to said lower surface and said launching surface for propelling said aircraft through an air medium,
3. means in said body to impart the rotary motion from said motive means to said propeller,
4. wings extending outwardly from said body and capable of being in a relatively horizontal plane on launching, and
5. said propeller having a propeller length at least greater than one half of the length of said wings.

15. The toy vehicle set of claim 14 further characterized in that said toy aircraft has a tail which has a height at least greater than one-fourth the length of said body.

16. The toy vehicle set of claim 14 further characterized in that said toy aircraft has a tail which has a height at least one-third greater than the length of said body.

17. The toy vehicle set of claim 14 further characterized in that said propeller length is approximately equal to the length of the body.

18. The toy vehicle set of claim 14 further characterized in that manually operable means is operatively associated with said motive means to generate rotary motion; and accelerator means is operatively associated with said motive means to substantially increase the speed of rotation which would have otherwise been generated in absence of said accelerator means.

19. The toy vehicle set for propelling a propeller driven aircraft from a hand-held launcher, said toy vehicle set comprising:

a. a hand-held launcher comprised of:
1. frame means,
2. a launching mount on said frame means and having a launching surface capable of being disposed in a horizontal plane,
3. a forwardly extending hub on said frame means and and having a relatively flat forwardly facing flat mounting surface perpendicular to said launching surface,
4. motive means retained by said frame means to generate rotary motion,
b. a propeller driven aircraft comprised of:
1. a fuselage,
2. a pod extending downwardly from said fuselage and having a rearwardly presented wall capable of being alignable with said mounting surface,
3. said fuselage having a mating surface perpendicular to said rearwardly presented wall and engageable with said launching surface and capable of being disposed on and resting upon said launching surface when in said horizontal plane,
4. mating interlocking means on said rearwardly presented wall of said pod and said mounting surface to hold said vehicle on said launcher until launching thereof such that the initial trajectory of said aircraft is initially parallel to said launching surface, and
5. a pair of opposed outwardly extending wings substantially parallel to said launching surface.

20. The toy vehicle set of claim 19 further characterized in that said aircraft has a rotatable propeller which is substantially parallel to said rearwardly presented wall and is powered for rotation by said motive means through said mating interlocking means.

21. The toy vehicle set of claim 19 further characterized in that said propeller length is at least one-half of the length of the wings.

22. The toy vehicle set of claim 19 further characterized in that said propeller length is approximately equal to the length of the body.

23. A toy set comprised of:

a. a launcher comprising:
1. a housing,
2. a gear containing drive mechanism retained by said housing,
3. drive shaft means operatively connected to said gear containing drive mechanism,
4. actuating means for actuating said drive mechanism and thereby imparting rotation to said drive shaft means upon manual actuation of said actuating means,
5. interlock means operatively associated with one end of said drive shaft means, and
b. a flying vehicle comprising:
1. a vehicle body,
2. a rotary member including rotatable shaft means associated with said body for driving said body when rotation is imparted to said rotatable shaft means, 3. cooperating means on one end of said rotary shaft means engageable in detachably interlocking relationship with said interlock means and being detachable therefrom only when the speed of rotation of said rotary shaft means exceeds the speed of rotation of said drive shaft means, and
4. means forming parts of said interlock means and said cooperating means to maintain said interlocking relationship when the speed of rotation of said rotary shaft means is less than the speed of rotation of said drive shaft means but which automatically creates disengagement therebetween when the speed of rotation of said rotary shaft means exceeds the speed of rotation of said drive shaft means.

24. A toy set comprised of:

a. a launcher comprising:
1. a housing,
2. a gear containing drive mechanism retained by said housing,
3. drive shaft means operatively connected to said gear containing drive mechanism,
4. actuating means for actuating said drive mechanism and thereby imparting rotation to said drive shaft means upon manual actuation of said actuating means,
5. said actuating means comprising a pull-string to impart rotation to at least one gear in said gear containing drive mechanism upon pulling of said string,
6. rewind means operatively associated with said housing to return said pull-string to its original position after a pull stroke,
7. said gear containing drive means including a member projecting through said housing for manual actuation to return the pull string to its original position, and
8. interlock means operatively associated with one end of said drive shaft means, and b. a flying vehicle comprising:
1. a vehicle body,
2. a pair of wings extending from said vehicle body,
3. a rotary member including rotary shaft means associated with said body for driving said body when rotation is imparted to said rotary shaft means,
4. a propeller driven by said rotary shaft means in a plane substantially perpendicular to the plane of extension and said wings,
5. and cooperating means on one end of said rotary shaft means engageable in detachably interlocking relationship with said interlock means and being detachable therefrom upon rotation of said rotary shaft means so that said flying vehicle is capable of being propelled into flight with an initial horizontal trajectory.

25. A toy set comprised of:

a. a launcher comprising:
1. a housing having a launching surface capable of being disposed in a horizontal plane, said housing also having a forwardly extending hub with a relatively flat forwardly facing surface substantially perpendicular to said launching surface,
2. means forming a plurality of spaced apart slots in said hub,
3. a gear containing drive mechanism retained by said housing,
4. drive shaft means operatively connected to said gear containing drive mechanism,
5. actuating means for actuating said drive mechanism and thereby imparting rotation to said drive shaft means upon manual actuation of said actuating means, and
6. interlock means operatively associated with one end of said drive shaft means, and b. a flying vehicle comprising:
1. a vehicle body having a fuselage and a pod extending downwardly from said fuselage with a rearwardly presented wall capable of being aligned with said mounting surface, said fuselage having a mating surface engageable with said launching surface and resting on said fuselage when in a horizontal plane,
2. a pair of wings extending from the fuselage of said vehicle body,
3. a plurality of flanges extending rearwardly from said pod and being spaced and located thereon to extend into said slots and retentively hold said body on said housing in a relatively horizontal plane,
4. a rotary member including rotary shaft means associated with said body for driving said body when rotation is imparted to said rotary shaft means,
5. a propeller driven by said rotary shaft means in a plane substantially perpendicular to the the plane of extension of said wings,
6. and cooperating means on one end of said rotary shaft means engageable in detachably interlocking relationship with said interlock means when said flanges are located in said slots and being detachable therefrom upon rotation of said rotary shaft means so that said flying vehicle is capable of being propelled into flight with an initial horizontal trajectory.

26. The toy set of claim 25 further characterized in that said gear containing drive mechanism comprises accelerator means to substantially increase the speed of rotation imparted to said rotary shaft means.

27. The toy set of claim 25 further characterized in that said interlock means comprises a member having a somewhat circularly shaped slot, and said cooperating means forms part of said interlock means and comprises an interlock flange extendible into said circularly shaped slot and being removable therefrom upon rotation of said rotary shaft means relative to rotation of said drive shaft means.

28. The toy set of claim 27 further characterized in that said interlock flange is removable from said circularly shaped slot only when the speed of rotation of said rotary shaft means exceeds the speed of rotation of said drive shaft means.

* * * * *

UNITED STATES PATENT OFFICE

CERTIFICATE OF CORRECTION

PATENT NO. : 3,995,392

DATED : December 7, 1976

INVENTOR(S) : A.E. Goldfarb, et al

It is certified that error appears in the above-identified patent and that said Letters Patent are hereby corrected as shown below:

In Claim 11, Column 9, line 13, change "ap-" to --a--.

In Claim 24, at Column 11, line 49, change "and" to -- of --.

Signed and Sealed this

Twenty-second Day of March 1977

[SEAL]

*Attest:*

RUTH C. MASON
*Attesting Officer*

C. MARSHALL DANN
*Commissioner of Patents and Trademarks*